US010973261B2

(12) United States Patent
Crowe

(10) Patent No.: US 10,973,261 B2
(45) Date of Patent: Apr. 13, 2021

(54) VAPORIZATION DEVICE AND PROCESS

(71) Applicant: Vuber Technologies, LLC, Seattle, WA (US)

(72) Inventor: David Crowe, Lake Forest Park, WA (US)

(73) Assignee: Vuber Technologies, LLC, Seattle, WA (US)

( * ) Notice: Subject to any disclaimer, the term of this patent is extended or adjusted under 35 U.S.C. 154(b) by 426 days.

(21) Appl. No.: 15/872,186

(22) Filed: Jan. 16, 2018

(65) Prior Publication Data

US 2019/0008207 A1 Jan. 10, 2019

Related U.S. Application Data

(60) Provisional application No. 62/529,068, filed on Jul. 6, 2017.

(51) Int. Cl.

| | |
|---|---|
| ***A24F 47/00*** | (2020.01) |
| ***H05B 3/44*** | (2006.01) |
| ***H05B 1/02*** | (2006.01) |

(52) U.S. Cl.

CPC ..... *A24F 47/008* (2013.01); *H05B 1/0227* (2013.01); *H05B 3/44* (2013.01)

(58) Field of Classification Search

CPC ..... A24F 47/008; A24F 40/20

See application file for complete search history.

(56) References Cited

U.S. PATENT DOCUMENTS

| | | | | |
|---|---|---|---|---|
| 2013/0192623 | A1* | 8/2013 | Tucker | H05B 3/10 131/329 |
| 2014/0216483 | A1* | 8/2014 | Alima | A24F 47/008 131/329 |
| 2015/0128971 | A1* | 5/2015 | Verleur | A24F 47/008 131/329 |
| 2017/0231283 | A1* | 8/2017 | Gadas | A24F 7/02 131/329 |
| 2017/0295845 | A1* | 10/2017 | Bajpai | A61M 11/003 |
| 2018/0043115 | A1* | 2/2018 | Gould | A61M 15/0021 |
| 2018/0177958 | A1* | 6/2018 | Wilder | A61M 11/042 |

* cited by examiner

*Primary Examiner* — Eric Yaary

(74) *Attorney, Agent, or Firm* — Occhiuti & Rohlicek LLP

(57) ABSTRACT

It is the object of the present invention to eliminate the disadvantages of the traditional dabbing method by providing a device and associated method that will reliably allow users to divide and collect a desired small quantity of Extract from a larger or bulk quantity of Extract and to conduct the small quantity of extract toward a Vaporizer heating element with minimal loss or wastage of Extract during the process, while significantly reducing required precision and effort associated Extract handling. The present invention of device and associated method result in a simpler, cleaner, and more efficient dabbing process.

9 Claims, 6 Drawing Sheets

VAPORIZATION DEVICE AND PROCESS

CROSS-REFERENCE TO RELATED APPLICATIONS

This application claims priority to U.S. Provisional Application No. 62/529,068 filed Jul. 6, 2017. The content of the above application is incorporated by reference in its entirety.

FIELD OF THE DISCLOSURE

The overall field of invention is devices and methods for vaporization of liquids and solids.

BACKGROUND

Cannabis has long been used medicinally and recreationally. Cannabis contains numerous compounds known as cannabinoids. Cannabinoids may be medicinal and/or psychoactive. Tetrahydrocannabinol (THC) is the primary psychoactive compound, though it also has medicinal properties. Cannabidiol (CBD) is the primary medicinal compound, and it may have little to no psychoactive effect. THC and CBD are considered the Active Compounds, as are numerous other cannabinoids.

Active Compounds may be extracted from the cannabis plant through a wide variety of processes, and the cannabinoid extract (Extract) take many forms or consistencies. Chemically, Extracts may vary significantly in their chemical content, ranging from almost entirely THC, to almost entirely CBD, along with varying levels of purity regarding non-medicinal and non-psychoactive compounds. Physically, Extracts also vary significantly, including liquid oils of widely varying viscosity, solid waxes of widely varying plasticity, and other semi-solid forms that exist as combinations of oil and wax. Extracts of different consistencies may be colloquially referred to as oil, wax, honeycomb, shatter, crumble, sap, budder, and pull-and-snap. The chemical content and form or consistency of Extract depends on factors including the plant feedstock from which the Extract is extracted, the specific process through which extraction occurs, and any post-extraction processing such as dilution, mixing, or physical processing. Extraction technology is advancing, and processes include butane, $CO_2$, and other hydrocarbon extraction processes are common.

Traditionally, Active Compounds were introduced into the human body for medicinal or psychoactive purposes by smoking or eating the cannabis plant. Recently, vaporization has gained prevalence as a means for consumption. Vaporization differs from smoking in that the cannabis plant or Extract is heated to a temperature high enough to volatilize Active Compounds into vapor but low enough to avoid combustion. Combustion products and byproducts, such as smoke and $NO_x$, may be undesirable for consumption for a variety of reasons, including health effects and flavor preference. Vaporization optimally produces no smoke. Vaporization is also a highly controllable process, whereby the amount of heating applied to either the plant or Extract can be precisely controlled, and the size of the resulting dose of Active Compounds is much more predictable than the size of a dose taken through smoking.

Devices used for vaporizing Extract (Vaporizers) generally must be adapted to operate with specific types or consistencies of extract. Most Vaporizers that are adapted to operate using oil Extract, for example, operate by a wicking mechanism in which a wick transports liquid Extract from a reservoir to a heating element. Vaporizers adapted to vaporize solid Extracts generally require the user to physically introduce a portion of solid Extract to the heating element using a small scooping tool or "dab tool." The process of introducing solid Extract to the heating element is often referred to as "dabbing."

Solid, semisolid, and liquid Extracts are inherently extremely sticky. In the Dabbing process, the dab tool is used to separate or scoop a small portion of Extract. The Extract has a strong tendency to stick or adhere to the dab tool. A user is required to manipulate the Extract that has adhered to the dab tool such that the small portion of Extract is placed in contact with the heating element with the goal of having the small portion adhere to the heating element while releasing its bond from the dab tool.

In most available Vaporizers, the heating element resides at the bottom of a small cylindrical chamber that is open at the top. The dab process will involve a user scooping the small portion of Extract onto the tool then using the tool to reach down the length of the cylindrical chamber to reach the heating element with the Extract. The width of the chamber is generally 1-2 cm. The process of reaching down the length of the chamber with the Extract is fairly exacting and difficult for users. Users frequently incidentally contact the side of the cylindrical chamber with the portion of Extract, and because of its sticky nature, it will tend to adhere to anything it contacts, including the cylinder walls.

Because the amount of heat produced by the heating element of most vaporizers is relatively small, only Extract that is in direct contact with the heating element will be heated sufficiently to vaporize. Extract that is deposited near the heating element may melt and eventually flow to the heating element and vaporize. Extract that is deposited within the chamber, but too far from the heating element, will not be vaporized unless it is repositioned nearer to the heating element.

In general, the sticky nature of Extract makes it difficult to efficiently deposit Extract on the Vaporizer heating element. In general, there tends to be a significant amount of wasted Extract that is deposited on the chamber walls or outside of the chamber rather than being successfully deposited on or near the heating element.

Liquid Extract is frequently distributed in syringes. Users are able to operate the syringe to deposit the liquid Extract where desired. The liquid Extract is generally a very viscous and sticky liquid, which tends to form tendrils as it is deposited. Users will use the needle portion of the syringe to reach into the chamber to deposit the Extract on the heating element. This method of introducing Extract to a Vaporizer heating element generally presents similar disadvantages to dabbing solid Extract. Any liquid Extract drops or tendrils that come into contact with the chamber walls are likely to remain unvaporized and wasted.

Extract handling is occasionally aided by the addition of heat, which tends to liquefy and lower the viscosity of Extract. Heated liquid Extract behavior is dominated by surface tension, and it will tend to strongly adhere to and coat certain materials such as metal, while beading and moving away from other materials, such as quartz. Heated Extract will not form tendrils while it is being divided due to the dominant forces of surface tension acting upon and within the Extract.

A need exists for a device for, or system of, portioning solid or liquid Extract and introducing said portion to a Vaporizer heating element in a simple, predictable, reliable, and efficient manner.

SUMMARY

It is the object of the present invention to eliminate the disadvantages of the traditional dabbing method by providing a device and associated method that will reliably allow users to divide and collect a desired small quantity of Extract from a larger or bulk quantity of Extract and to conduct the small quantity of extract toward a Vaporizer heating element with minimal loss or wastage of Extract during the process, while significantly reducing required precision and effort associated Extract handling. The present invention of device and associated method result in a simpler, cleaner, and more efficient dabbing process.

DEFINITIONS

Figure 1:
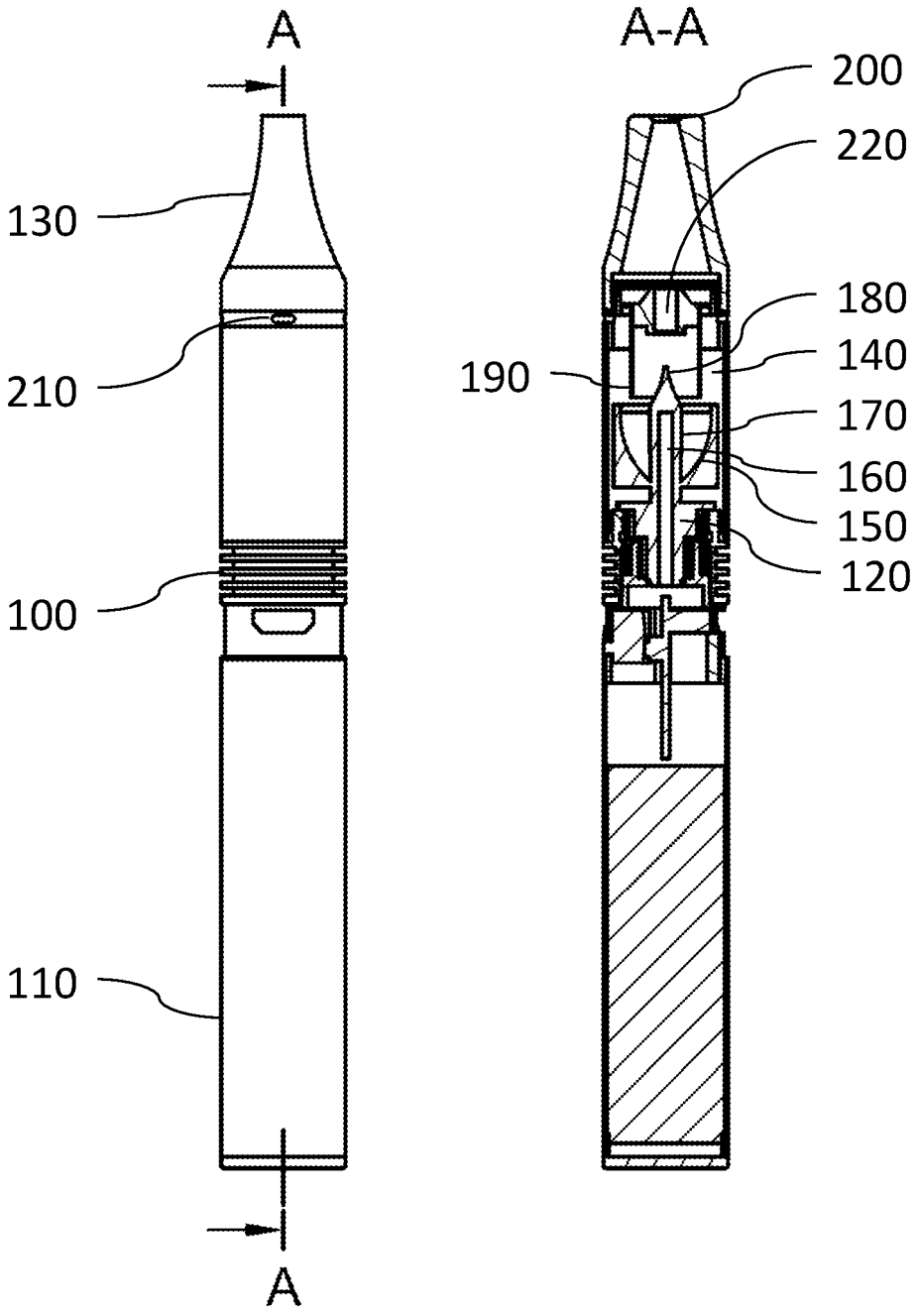
FIG. 1 Shows a front view and section view of a Vaporizer.

Vapor: Gaseous or suspended liquid condensate Extract suitable for inhalation.

Vaporizers: Devices used for vaporizing Extract comprised of an Atomizer and a power source such as a battery, fuel cell, or power supply.

Battery: A device adapted for use in Vaporizers capable of supplying voltage with an incorporate switch, operable by a user such that the user is able to control whether a voltage will be supplied to vaporizer heating circuitry.

DETAILED DESCRIPTION

In the Summary above, Detailed Description, claims below, and accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100, and includes both 25 and 100.

The present invention is a device and an associated method that allow for significantly simpler and more efficient handling of Extract during the dabbing process by incorporating a heated tool for Extract handling that will allow a user to apply a portion of Extract to said tool, and then operate the device such that any Extract on the tool may be vaporized by simple operation of the Vaporizer.

FIG. 1 is a front view and section view of a Vaporizer. The Vaporizer is comprised of an atomizer 100 and a battery 110. The atomizer 100 is comprised of an atomizer core assembly 120 and a mouthpiece assembly 130. The atomizer core assembly 120 and mouthpiece assembly 130, when assembled, form a vaporization chamber 140. The lower portion of the vaporization chamber 140 is a vaporization bowl 150. An ohmic heating element 160 is embedded within the atomizer core assembly 120, such that the atomizer core assembly 120 can be heated by operating the device such that current is supplied by the battery 110 to the ohmic heating element 160. A protruding member 170 extends upward from the vaporization bowl 150. The protruding member 170 terminates in an effector tip 180. The vaporization bowl 150 and protruding member 170 are formed such that when the vaporization bowl 150 is heated, any Extract contained within the bowl 150 or adhered to the protruding member 170 will liquefy and flow toward gravity. The bottom of the vaporization bowl 150 and the protruding member 170, which are nearest to the ohmic heating element 160, will tend to be hottest during the operation of the device. Therefore, Extract nearer to the bottom of the bowl 150 or on the protruding member 170 surface will tend to vaporize more quickly. The heating element 160, the bowl 150, and the protruding member 170 are designed such that during operation, the bowl 150 and the protruding member 170 are sufficiently heated such that Extract that is in contact with the surfaces of the bowl 150 or member 170 will melt, liquefy, and either vaporize directly or flow toward gravity such that the liquid extract will eventually come into contact with a surface of sufficiently high temperature to vaporize the extract. As such, effectively all Extract contained or adhered to either the bowl 150 or the member 170 can be vaporized by operating the device to supply electric current to the heating element.

As Extract is vaporized, Extract particles and condensates of various sizes become airborne or suspended in the air. Particles of extremely small size are considered Vapor and are suitable for inhalation. Particles of larger size can be considered spatter, and are less suitable for inhalation. The vaporization chamber 140 incorporates interior baffling to create a spatter shield 190. During use, a user will inhale at the inhalation port 200 on the mouthpiece. The resultant pressure gradient caused by inhalation will cause air to ingress into the vaporization chamber 140 through ingress ports 210, to accept some amount of vaporized Extract, and to flow through an egress port 220, before reaching the inhalation port 200.

The mouthpiece assembly 130 serves to enclose the vaporization process such that vapor is contained until inhalation. The contour of surfaces, arrangement, and orientation of the surfaces of the vaporization bowl 150 and protruding member 170, in combination with the spatter shield 190 and position of the egress port 220, significantly reduce the likelihood that spatter will be inhaled during use.

Figure 2:
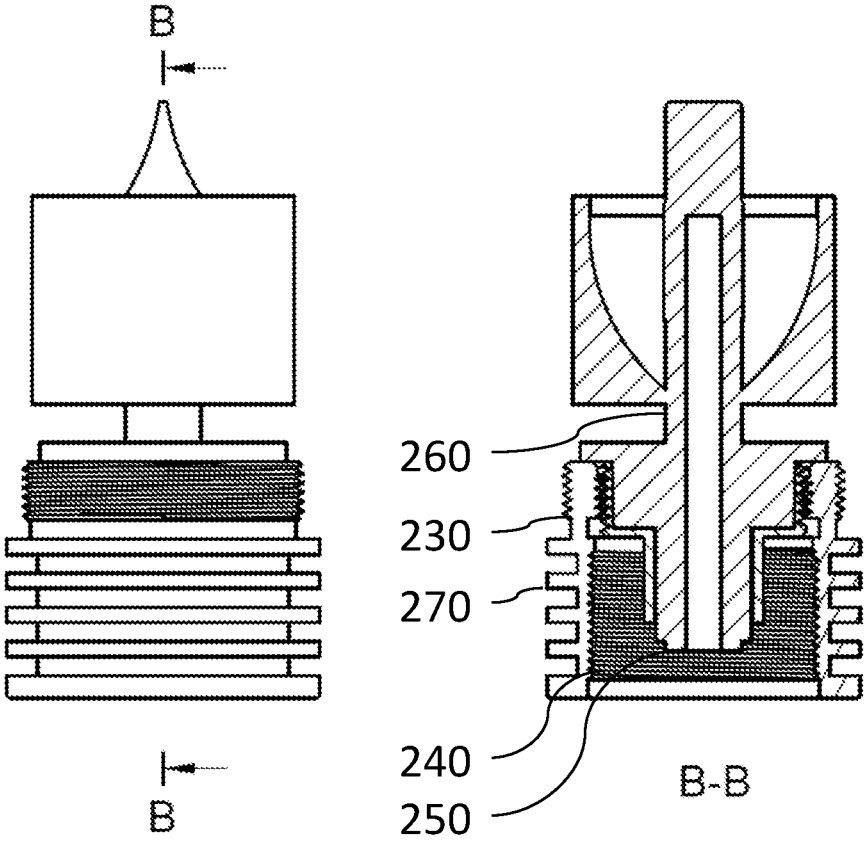
FIG. 2 Shows a front and section view of the atomizer core assembly.

FIG. 2 is a front and section view of the atomizer core assembly 120. The core is adapted to be combined with standard vaporizer batteries via an adapter ring 230 that incorporates internal threading 240 into which a standard battery may be threaded. The core also incorporates standard positioning of electrical contacts 250 that, when attached to a vaporizer battery, can form a closed circuit through which electrical current may flow.

The embedded ohmic heating element 160 will transfer heat to the atomizer core assembly 120 during operation. Heat will be conducted through the bulk material of the core 120 according to temperature gradients and thermal resistivity of the materials. Users are likely to hold or touch the outer surface of the core assembly during device use. Therefore, in the preferred embodiment, the material geometry of the core, bowl, and adapter ring are designed to preferentially heat the vaporization bowl 150 and protruding member 170, while maintaining much lower temperatures for surfaces exposed to users. The lower surface temperatures are achieved by means of a thermal neck, 260 which serves to thermally isolate the bowl 150 and protruding member 170, and external cooling fins 270, which serve to maximize heat dissipation to the environment. The external cooling fins 270 are the only portion of the atomizer core that a user will physically touch during vaporization, so the potential for burns or user discomfort are mitigated. Furthermore, by preferentially heating the bowl 150 and member 170, heating and associated electrical power requirements are reduced, which results in more efficient operation of the device.

Figure 3:
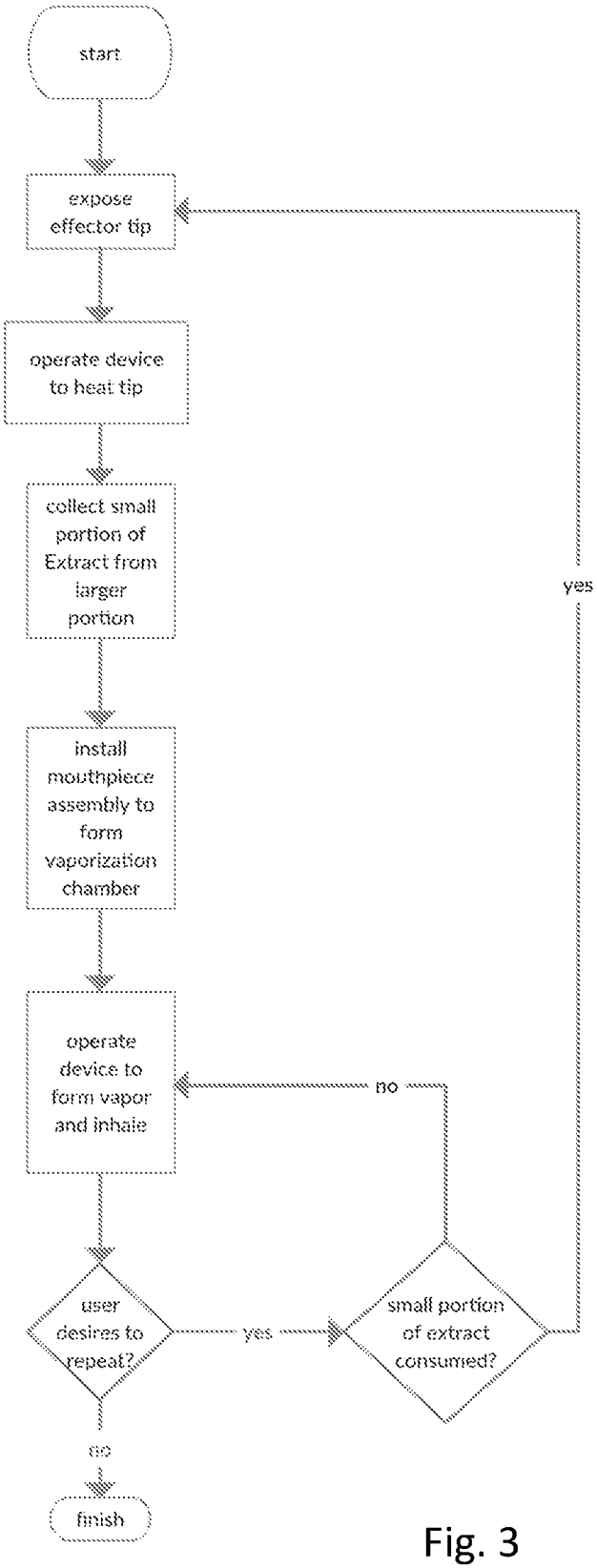
FIG. 3 Show a flow diagram of the preferred method of operation of the device.

FIG. 3 shows a flow diagram of the preferred method of operation of the device. Typical operation of the device will begin with the device in a partially disassembled state in which the effector tip 180 is exposed by removing the mouthpiece assembly 130. The second step is to heat the effector tip 180 by operating the device, typically by means of operating a button or switch on the battery that will complete the circuit with the heating element 160, and cause the effector tip 180 temperature to increase and become sufficiently hot to improve Extract handling characteristics. Users are able to manually control tip temperature by opening and closing the heating element circuit using the battery switch or button. A user will employ the heated effector tip 180 to heat and collect a small portion of Extract from a larger portion of extract. A user will then install the mouthpiece assembly 130 such that the assembly 130 and the atomizer core 120 form a vaporization chamber 140. The user will then operate the device again to heat the collected Extract to a temperature sufficient to vaporize said Extract.

In an alternative method of operating the device, the effector tip is not heated prior to interacting with Extract. While Extract handling properties tend to improve when Extract is heated, heating may not be a necessary step when collecting the small portion of Extract.

The effector tip 180 is shaped generally to allow convenient handling of Extract. During the collection phase of the device usage, a user may be required to divide, scoop, smear, and otherwise handle and affect Extract. The preferred embodiment of the effector tip is a chisel tip. The chisel tip allows users to readily divide and scoop Extract. Additionally, the preferred embodiment of the effector tip 180, protruding member 170, and vaporization bowl 150 are formed of metal, which has desirable properties for interacting with liquefied Extract. Liquefied Extract will tend to coat and disburse across the surface of most metals. Therefore, metal Extract collection surfaces aid in expedient collection of Extract. Furthermore, the atomizer core 120 should be made of a material of sufficient thermal conductivity to allow the heat generated by the heating element 150 to readily heat any surfaces likely to interact with the collected portion of extract. The thermal properties of metal are well-suited to the required thermal conductivity requirements. In alternative embodiments the atomizer core components may be made of or coated by other nonmetal materials including glass, crystal, ceramic, composite, plastic or any combination thereof. Other portions of the vaporizer, such as the mouthpiece assembly components may be made from any material of sufficient mechanical integrity to withstand repeated use. Materials for the mouthpiece assembly may be metal, glass, ceramic, plastic, wood, crystal, polymer, composite, or any combination thereof.

Figure 4:
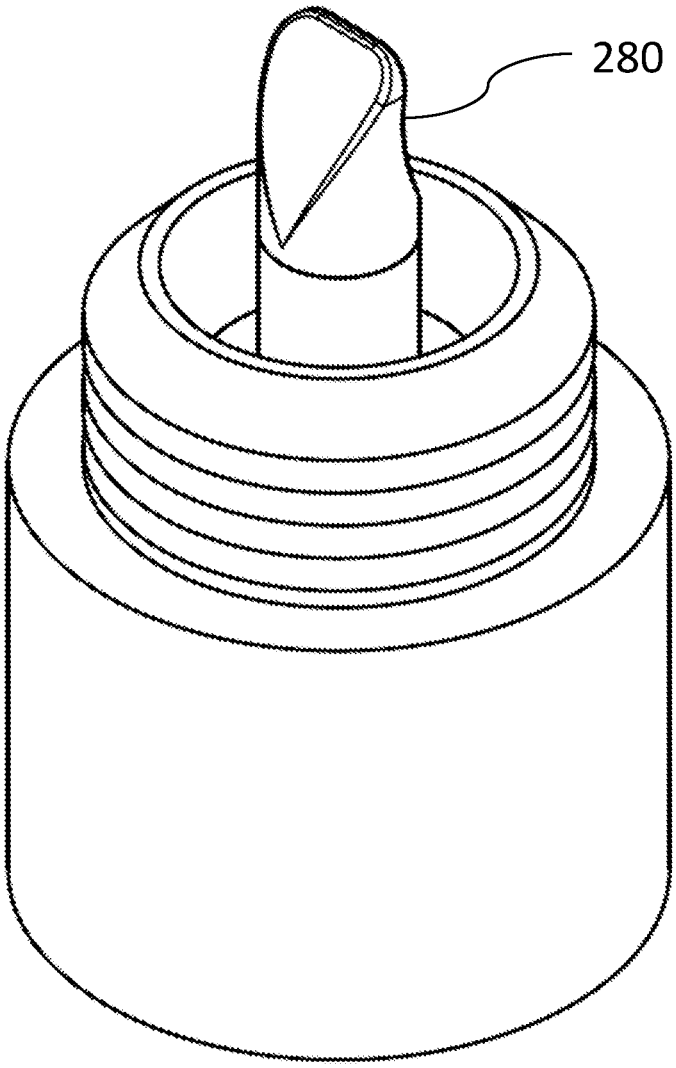
FIG. 4 Shows an isometric view of an alternative embodiment of the atomizer core.
Figure 5:
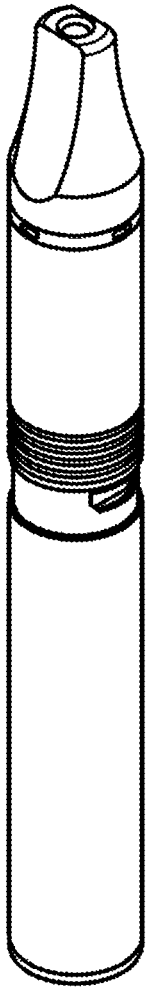
FIG. 5 Shows an isometric view of a Vaporizer.
Figure 6:
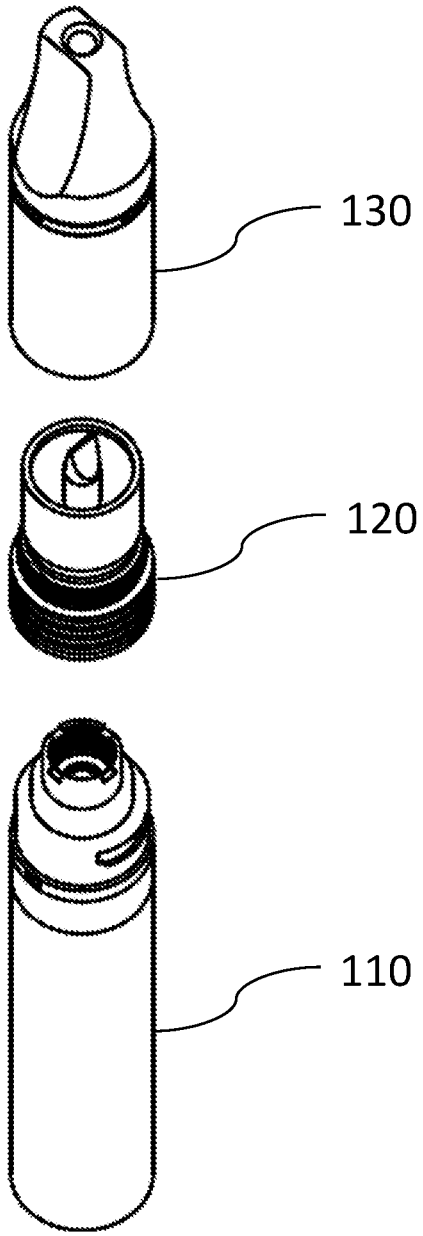
FIG. 6 Shows an exploded view of a Vaporizer.

FIG. 4 shows an isometric view of an alternative embodiment of the atomizer core assembly in which one face of the chisel effector tip forms a concave surface 280. The alternative embodiment integrates the battery interface and eliminates the cooling fins.

PREFERRED METHOD OF USE

In the preferred method of use, the user begins with the device in a partially disassembled state in which the mouthpiece assembly 130 is removed and the effector tip 180 is exposed. The user then operates a switch on an electrically connected battery unit that supplies electrical current to the heating element circuit, thereby heating the effector tip 180. The user then collects a small portion of Extract onto the effector tip 180. The user will then install the mouthpiece assembly 130. The user will orient the device vertically such that the lower battery portion of the device is toward gravity and the upper mouthpiece portion of the device is away from gravity. The user will then operate the device to again heat the Extract, this time to a temperature sufficiently high to vaporize the Extract. The user will inhale vaporized Extract through the inhalation port 200 of mouthpiece.

While preferred and alternate embodiments have been illustrated and described, as noted above, many changes can be made without departing from the spirit and scope of this VAPORIZATION DEVICE AND PROCESS. Accordingly, the scope of the is not limited by the disclosure of these preferred and alternate embodiments. Instead, the scope of the VAPORIZATION DEVICE AND PROCESS is to be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶ 6. In particular, the use of "step of" in the claims herein is not intended to invoke the provisions of U.S.C. § 112 ¶ 6.

The invention claimed is:

1. An atomizer comprising:

an enclosure which forms a vaporization chamber, said enclosure having a removable portion, a fixed portion, and a protruding member having a proximal end and a distal end, said distal end terminating in an effector tip, said proximal end being fixed to a surface of said fixed portion of said vaporization chamber such that said protruding member is contained within said enclosure, a heating element positioned proximally to said vaporization chamber and adapted to heat said protruding member and effector tip to at least 140° C., and said removable portion of said enclosure being removable to expose said protruding member and effector tip, wherein the effector tip extends beyond the surface of the fixed portion when the removable portion is removed.

2. The atomizer of claim 1 wherein said effector tip is removably attached to said protruding member.

3. The atomizer of claim 1 further wherein said fixed portion of said enclosure forms a vaporization bowl.

4. The atomizer of claim 3 further comprising:

an egress port providing fluid communication between said vaporization chamber and atmosphere, and a spatter shield surrounding said effector tip.

5. The atomizer of claim 4 wherein said heating element is an ohmic heating element.

6. The atomizer of claim 5 wherein said ohmic heating element is positioned within said protruding member.

7. The atomizer of claim 6 wherein said heating element is adapted to heat said protruding member and effector tip to between 180° C. and 210° C.

8. A method for vaporizing Extract comprising:

Operating a vaporizer to expose an effector tip, heating said effector tip via a heating element prior to collection, using said effector tip to collect a portion of Extract, operating said vaporizer to enclose said effector tip within a vaporization chamber, and heating said effector tip via the heating element sufficiently to vaporize said portion of Extract.

9. The method of claim 8 further comprising: evacuating said vaporized Extract from the vaporization chamber.

* * * * *